United States Patent [19]

Lugscheider et al.

[11] Patent Number: 4,546,483

[45] Date of Patent: Oct. 8, 1985

[54] PLASMA MELTING FURNACE ARRANGEMENT

[75] Inventors: Walter Lugscheider, Linz; Alois Leutgöb, Steyr; Ernst Riegler, Enns; Ernst Zajicek, Ottensheim; Othmar Pühringer, Linz, all of Austria

[73] Assignee: Voest-Alpine Aktiengesellschaft, Linz, Austria

[21] Appl. No.: 536,243

[22] Filed: Sep. 27, 1983

[30] Foreign Application Priority Data

Oct. 5, 1982 [AT] Austria ..... 3673/82

[51] Int. Cl.[4] ..... H05B 7/00

[52] U.S. Cl. ..... 373/24; 266/200; 266/900; 266/901; 373/22

[58] Field of Search ..... 266/901, 200, 203, 242, 266/900; 373/18-24, 81

[56] References Cited

U.S. PATENT DOCUMENTS

| | | | |
|---|---|---|---|
| 3,422,206 | 1/1969 | Baker et al. | 373/24 |
| 3,536,343 | 10/1970 | Casperson et al. | 266/901 |
| 3,756,582 | 9/1973 | Overmyer et al. | 266/900 |
| 4,006,284 | 2/1977 | Segsworth et al. | 373/19 |
| 4,018,973 | 4/1977 | Paton et al. | 373/18 |
| 4,414,673 | 11/1983 | Lugscheider et al. | 373/22 |

*Primary Examiner*—Melvyn J. Andrews
*Assistant Examiner*—S. Kastler
*Attorney, Agent, or Firm*—Burns, Doane, Swecker & Mathis

[57] ABSTRACT

There is disclosed a plasma melting furnace through the side wall of whose cylindrical furnace body a plurality of downwardly directed plasma burners are guided, whose mouths project into the furnace interior. In order to avoid several rechargings, which has been common so far, in particular with scrap of low apparent density, and to be able to charge continuously, without endangering the plasma burners by electric flashovers between parts of the charge material and the burner mouths or falling-down materials and by maintaining the inert gas atmosphere within the furnace, the cover of the furnace interior comprises a shoulder-likely reentering part projecting upwardly. This part is closeable by a lid and delimits a central charging opening whose diameter is smaller than the diameter of the circle on which the mouths of the plasma burners are arranged.

4 Claims, 2 Drawing Figures

PLASMA MELTING FURNACE ARRANGEMENT

Figure 1:
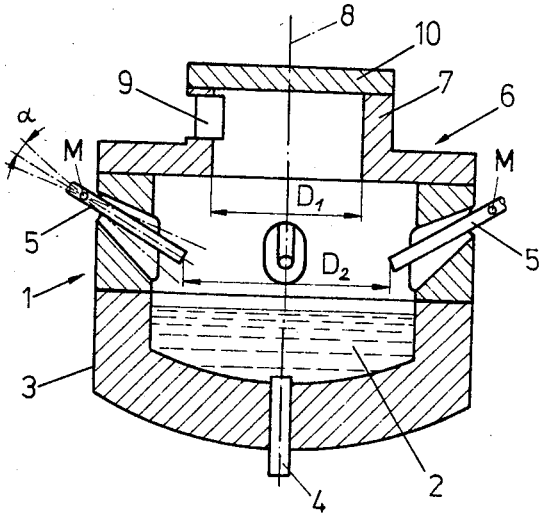

The invention relates to a plasma melting furnace comprising a refractorily lined cylindrical furnace body through the side wall of which a plurality of downwardly directed plasma burners are guided, whose mouths project into the furnace interior beyond the inner surface of the furnace body, and a refractorily lined cover closing the furnace interior.

Plasma melting furnaces of this kind are used in particular to melt down scrap. The plasma melting furnaces of usual designs are charged with the solid charge to be melted only to such an extent that the furnace interior present above the mouths of the plasma burners remains free of charge material, since otherwise electric flashovers might occur between parts of the charge and the burner mouth during the melt-down process, which result in the failure or even destruction of the plasma burners. The furnace filling volume available, therefore, in general, may be utilized only up to 30%, up to 50% at a maximum, so that, in particular if the plasma melting furnace is charged with scrap of a low apparent density, it has to be recharged once or several times in order to utilize the furnace capacity as economically as possible. Recharging upon melting down of the scrap portions already introduced into the furnace interior involves serious disadvantages. Thus, the furnace cover has to be lifted again and again and the plasma burners must be retracted from the furnace interior. In addition, it is particularly difficult and connected with considerable losses of inert gas to prevent the access of secondary air to the melt during the charging operation.

The invention has its object to eliminate the difficulties pointed out and to provide a plasma melting furnace that need be charged only once even with charges of low apparent densities, by utilizing the full furnace capacity without endangering the plasma burners by the occurrence of electric short-circuits or by falling-down parts of the charge material.

The set object is achieved according to the invention, with a plasma melting furnace of the initially defined kind, in that the cover comprises a shoulder-likely reentering part projecting upwardly and delimiting a central charging opening, which part is closeable by a lid, the diameter of the central charging opening being smaller than the diameter of the circle on which the mouths of the plasma burners are arranged. The lid is designed so as to be liftable and pivotable in a known manner.

During charging a charging cone forms, with a plasma furnace of the invention, whose diameter in the height of a horizontal plane laid through the mouths of the plasma burners may be kept smaller than the diameter of that circle on whose circumference the mouths of the plasma burners are arranged. The upwardly projecting part constitutes a charging shaft of choosable length. The top of the charging cone formed by the charge stock may reach as far as into this charging shaft without endangering the plasma burner mouths being within the furnace interior. In this manner, the optimum utilization of the furnace volume is guaranteed by a single charging operation.

Suitably, an exhaust opening for offgases is arranged laterally on the upwardly projecting part. This exhaust opening is in the region of the upper end of the upwardly projecting part.

So far, it has been a common practice to provide an opening in the furnace lid and to connect thereto an exhaust conduit for smoke and offgases. However, such a construction brought about considerable additional complications at each lifting of the lid, whereas the exhaust conduit remains stationary on the cover of the invention during charging.

The design of a plasma melting furnace according to the invention even makes possible the continuous charging of the furnace, the inert gas atmosphere in the furnace interior nevertheless being preserved. For this purpose, the exhaust opening in the cover is closed so that the hot furnace offgases flow counter the charge material introduced through the central opening of the cover. Thereby, the impurities introduced with the scrap are largely burnt off on the one hand, and the charge material is preheated on the other hand. The purified and preheated charge material ensures the optimum utilization of the energy radiated off the plasma burners.

In order not to damage the plasma burners, which are guided through the side wall of the cylindrical furnace body, by falling-down charge stock during charging, it may be an additional precautionary measure to withdraw the burners from the furnace interior in a known manner to such an extent that the burner mouths come to lie in the region of the furnace lining.

When continuously charging light scrap, there are basically provided two modes of operation with a plasma melting furnace according to the invention, i.e.:

melting of the entire scrap column prior to refining and purifying the steel, with steel qualities similar to electric steel being obtained as products;

melting of the light scrap to a molten metal having a composition similar to crude steel, which is tapped off discontinuously. The conversion of the crude steel into a finished product is carried out according to conventional metallurgical methods.

In particular for melting light scrap, the plasma burners preferably are horizontally and vertically pivotable, wherein it has proved favorable if each plasma burner is displaceable both horizontally and vertically by an angle of about $\pm 10°$ each, based on the normal position. On account of the low apparent density, less energy is required to melt light scrap as compared to heavy scrap, for the same charging volume. Therefore, it is more economical to distribute the energy radiated off the plasma burners over a larger volume region by pivotal movements.

Figure 2:
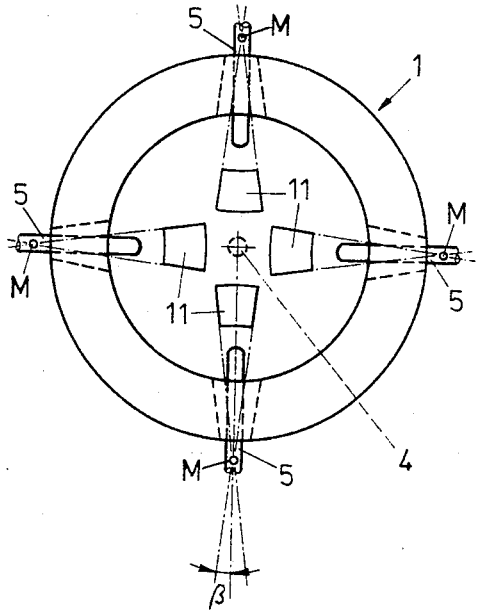

The invention will now be explained in more detail by way of the drawing. Therein:

FIG. 1 is a schematic section of a plasma melting furnace according to the invention, having a cylindrical furnace body and four downwardly directed pivotable plasma burners; and FIG. 2 is a top view on a plasma melting furnace according to FIG. 1 without cover and furnace lid.

The refractorily lined cylindrical furnace body of the plasma melting furnace illustrated in FIGS. 1 and 2 is denoted by 1, the furnace lower part, in which the molten stock 2 collects, is denoted by 3. The furnace lower part 3 is penetrated by an axially arranged bottom electrode 4. A slag door and a casting spout (not illustrated) are arranged in a usual manner in the region of the lower part 3 so as to be diametrically opposite.

Four plasma burners 5 led through the side wall of the furnace body 1 and directed downwardly are each moveably mounted on a supporting structure (not shown). A cover 6 is placed on the furnace body 1.

The shoulder-likely re-entering, upwardly projecting part 7 of the cover delimits a central charging opening, which, in the embodiment illustrated, is designed to be circular, its axis being identical with the longitudinal axis 8 of the furnace body 1. The diameter $D_1$ of the central charging opening is smaller than the diameter $D_2$ of the circle on which the mouths of the plasma burners 5 are arranged.

The exhaust opening 9 for offgases is laterally arranged on the upwardly projecting part 7 of the cover 6, forming a charging shaft. The charging opening is closed by a lid 10.

The plasma burners 5 are cardanically suspended, the suspension means being not illustrated. In their normal positions, the burners are inclined relative to the melt surface at an angle of about 29° and vertically pivotable each by an angle $\alpha$ of preferably 10°. In FIG. 2 the projections of the burner axes are entered in dot-and-dash lines. The plasma burners 5 are each pivotable also laterally about the pivot M by an angle $\beta$.

With the help of the pivotably mounted plasma burners, the radiation fields of the individual burners may be expanded to the volume elements 11 schematically indicated in FIG. 2.

What we claim is:

1. In a plasma melting furnace arrangement of the type including a refractorily lined furnace body defining a furnace interior and having a cylindrical side wall with an upper end and an inner surface, and a plurality of downwardly directed plasma burners guided through said side wall, said plasma burners having burner mouths projecting into said furnace interior beyond said inner surface, said furnace further including an attached refractorily lined cover affixed to said upper end, said cover closing said furnace interior, the improvement wherein said cover comprises a shoulder-like re-entering part projecting upwardly and defining a charging shaft, a central charging opening delimited by said part, and a removable lid to close said opening, and wherein said plasma burner mouths are arranged substantially along a circle of a certain diameter, said central charging opening being disposed above said circle and having a diameter that is smaller than the diameter of said circle.

2. A plasma melting furnace arrangement as set forth in claim 1, the improvement further comprising a closable exhaust opening arranged laterally on said upwardly projecting part for releasing offgases, said exhaust opening being closable during charging of the furnace for counter-flowing offgases against the charge material being introduced through said central opening.

3. A plasma melting furnace arrangement as set forth in claim 1, wherein said plasma burners are horizontally and vertically pivotable.

4. A plasma melting furnace arrangement as set forth in claim 2, wherein said plasma burners are horizontally and vertically pivotable.

* * * * *